US010112819B2

(12) United States Patent
Riis

(10) Patent No.: US 10,112,819 B2
(45) Date of Patent: Oct. 30, 2018

(54) EXTRACTOR TUBE

(71) Applicant: MICRO MATIC A/S, Odense SV (DK)

(72) Inventor: Ken Riis, Odense M (DK)

(73) Assignee: MICRO MATIC A/S, Odense SV (DK)

( * ) Notice: Subject to any disclaimer, the term of this patent is extended or adjusted under 35 U.S.C. 154(b) by 155 days.

(21) Appl. No.: 14/917,639

(22) PCT Filed: Sep. 9, 2014

(86) PCT No.: PCT/EP2014/069150

§ 371 (c)(1),
(2) Date: Mar. 9, 2016

(87) PCT Pub. No.: WO2015/036385

PCT Pub. Date: Mar. 19, 2015

(65) Prior Publication Data

US 2016/0221815 A1 Aug. 4, 2016

(30) Foreign Application Priority Data

Sep. 10, 2013 (EP) ..... 13183725

(51) Int. Cl.
*B67D 1/08* (2006.01)
*B67D 1/07* (2006.01)
(Continued)

(52) U.S. Cl.
CPC ..... *B67D 1/0802* (2013.01); *B08B 3/10* (2013.01); *B08B 9/0813* (2013.01); *B67D 1/07* (2013.01)

(58) Field of Classification Search
None
See application file for complete search history.

(56) References Cited

U.S. PATENT DOCUMENTS 4,458,833 A 7/1984 Bailey
5,072,917 A * 12/1991 Pleva ..... F16C 25/083 267/161
(Continued)

FOREIGN PATENT DOCUMENTS

CN 1608027 A 4/2005
CN 1864873 A 11/2006
(Continued)

OTHER PUBLICATIONS

Extended European Search Report dated Feb. 10, 2014 in European Application No. 13183725.4 (8 pages).
(Continued)

*Primary Examiner* — Nicole Blan
(74) *Attorney, Agent, or Firm* — Nixon & Vanderhye P.C.

(57) ABSTRACT

The present invention relates to an extractor tube element (6, 10, 14) for mounting as a part of an extractor tube (1) for a beverage container (16), comprising a contact surface (8) for abutment to another extractor tube element, wherein the contact surface (8) has a protrusion (9), the protrusion tapering into a contact point for reducing a contact area of the abutment to the other extractor tube element and for creating space between the abutting extractor tube elements. The present invention also relates to an extractor tube (1), a beverage container (16), a beverage dispensing system (100) and a cleaning method.

14 Claims, 9 Drawing Sheets

(51) Int. Cl.

| | |
|---|---|
| ***B08B 3/10*** | (2006.01) |
| ***B08B 9/08*** | (2006.01) |

(56) References Cited

U.S. PATENT DOCUMENTS

| | | | | |
|---|---|---|---|---|
| 6,349,560 | B1 † | 2/2002 | Maier-Laxhuber et al. | |
| 6,367,660 | B1 | 4/2002 | Chang | |
| 6,539,681 | B1 * | 4/2003 | Siegmund | E04F 15/02429 404/36 |
| 7,832,596 | B2 | 11/2010 | van der Klaauw et al. | |
| 2005/0217416 | A1 * | 10/2005 | Berry | B25C 1/06 74/572.21 |
| 2010/0163113 | A1 | 7/2010 | Bax | |

FOREIGN PATENT DOCUMENTS

| | | | |
|---|---|---|---|
| CN | 2868294 | Y | 2/2007 |
| CN | 101454238 | A | 6/2009 |
| CN | 103153838 | A | 6/2013 |
| DE | 2104635 | A † | 8/1972 |
| DE | 7318784 | U1 † | 8/1973 |
| DE | 35 15 351 | | 10/1986 |
| DE | 20114942 | U1 † | 2/2002 |
| DE | 10 2007 034379 | A1 † | 1/2009 |
| DE | 10 2011 108029 | A1 † | 1/2013 |
| EP | 2 625 133 | B1 | 10/2015 |
| JP | 2012-214245 | A | 11/2012 |
| WO | WO 2013/076263 | A1 | 5/2013 |

OTHER PUBLICATIONS

Notification of the First Office Action dated May 25, 2017 in Chinese Application No. 201480060576.5, with English translation (16 pages).

International Search Report for PCT/EP2014/069150 dated Dec. 2, 2014, four pages.

Written Opinion for PCT/EP2014/069150 dated Dec. 2, 2014, four pages.

Notification Concerning Transmittal of International Preliminary Report on Patentability (Chapter I of the Patent Corportion Treaty) dated Mar. 24, 2016 in International Application No. PCT/EP2014/069150 (6 pages).

Notification of the Third Office Action dated May 17, 2018 in Chinese Application No. 201480060576.5, with English translation (14 pages).

* cited by examiner
† cited by third party

EXTRACTOR TUBE

This application is the U.S. national phase of International Application No. PCT/EP2014/069150 filed 9 Sep. 2014 which designated the U.S. and claims priority to EP Patent Application No. 13183725.4 filed 10 Sep. 2013, the entire contents of each of which are hereby incorporated by reference.

FIELD OF THE INVENTION

The present invention relates to an extractor tube element for mounting as a part of an extractor tube for a beverage container, comprising a contact surface for abutment to another extractor tube element. The present invention also relates to an extractor tube, a beverage container, a beverage dispensing system and a cleaning method.

BACKGROUND ART

When a beverage container has been emptied and is to be refilled with beverage, the inside of the beverage container and the different components present in the beverage container, such as an extractor tube, must be cleaned first in a normal cleaning sequence on a filling line.

However, the known extractor tubes are made up of many different parts which when assembled cooperate with and are movable in relation to each other. Since the cleaning is carried out inside the beverage container by for instance flushing and steaming, and the extractor tubes have many parts, studies have shown that it is difficult to clean the inside of a beverage container properly.

SUMMARY OF THE INVENTION

It is an object of the present invention to wholly or partly overcome the above disadvantages and drawbacks of the prior art. More specifically, it is an object to provide an extractor tube element to be incorporated in an extractor tube, which facilitates the cleaning of the extractor tube while the extractor is assembled and present in the beverage container.

The above objects, together with numerous other objects, advantages and features, which will become evident from the below description, are accomplished by a solution in accordance with the present invention by an extractor tube element for mounting as a part of an extractor tube for a beverage container, comprising:

a contact surface for abutment to another extractor tube element, wherein the contact surface has a protrusion, the protrusion tapering into a contact point for reducing a contact area of the abutment to the other extractor tube element and for creating space between the abutting extractor tube elements.

By incorporating the protrusion which the other extractor tube element abuts, it is obtained that the contact area between the abutting elements is considerably reduced. Thus, by reducing the contact area between the abutting elements, the remaining area of the contact surfaces may be cleaned properly, since a space between the contact surfaces of two abutting elements have been created.

Hereby, a flow of detergent between the contact surfaces of two abutting elements may be allowed during cleaning.

The term "taper" is in this context to be construed as the protrusion ending in a single contact point for abutting another element. The tapering may be a straight line or it may be curved.

In an embodiment, the contact surface may have a plurality of protrusions.

The contact point may have a rounded tip.

The protrusion may have a shape of a bead, a cone, a frustum of a cone or a hemisphere.

Also, the protrusion may have a height of 1 mm to 10 mm.

Moreover, the contact surface may be substantially circular.

Furthermore, the protrusions may extend along the circular contact surface with a mutual distance between them.

Additionally, the protrusion may form part of the contact surface.

Further, the protrusion may be formed as part of the contact surface.

Also, the protrusion may be circular.

Moreover, the protrusion may have a crescent shape.

The extractor tube element as described above may be a retaining disc, a flange, a safety pin, a washer, a spring, a locking plate, a support plate, or a combination thereof.

Further, the contact surfaces may have a horisontal abutment and/or a vertical abutment.

The present invention also relates to an extractor tube comprising an extractor tube element as described above.

Furthermore, the present invention also relates to a beverage container comprising an extractor tube as described above.

Also, the present invention relates to a beverage dispensing system comprising a beverage container as described above and a dispense head.

Finally, the present invention relates to a cleaning method for cleaning a beverage container as described above, comprising the steps of:

emptying the beverage container of remaining beverage, flushing the beverage container with a detergent solution at a predetermined temperature, and circulating the detergent solution between two abutting contact surfaces wherein one of the contact surfaces is of an extractor tube element according to any of the claims 1-9.

The cleaning method as described above may comprise the step of steaming the beverage container at a predetermined temperature.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
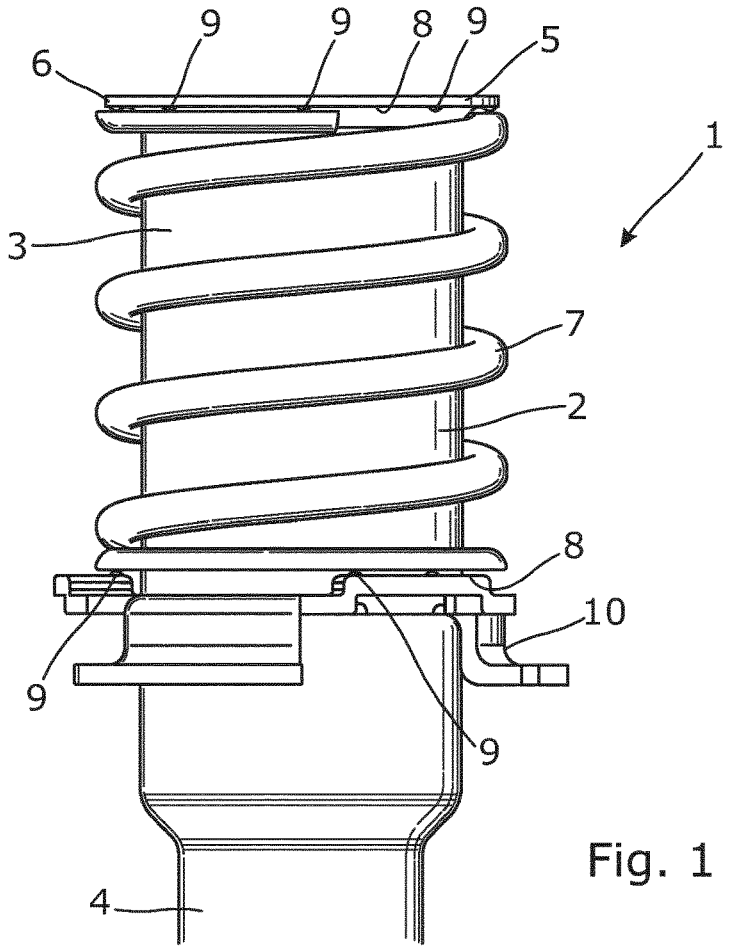
FIG. 1 shows a part of an extractor tube to be used in an S-system.

FIG. 1 shows a part of an extractor tube 1 to be used in an S-system. The extractor tube 1 comprises a down tube 2 having a first tube part 3 and a second tube part 4, the first tube part 3 having a larger diameter than the second tube part 4. At a first end 5 of the down tube 2, a radially projecting flange 6 is arranged. A spring 7 is arranged around the first tube part 3 and abuts the flange 6. The extractor tube element, here in the form of the flange 6, comprises a contact surface 8 which according to the inventive idea has a protrusion 9, the protrusion 9 tapering into a contact point for reducing a contact area of the abutment to the spring 7 and for creating space between the flange 6 and the spring 7. In this embodiment, the flange 6 is projecting out from the first tube part 3 and is surrounding it, so that the flange has a ring-shaped form. Since the spring 7 is adapted to abut a large part of the contact surface 8 of the flange 6, a plurality of protrusions have been arranged around the flange 6 in order to align the abutment between the contact surfaces of the flange 6 and the spring 7.

In the opposite end of the spring 7, a retaining disc 10 is arranged around the first tube part 3. The spring 7 abuts a contact surface 8 of the retaining disc 10. The contact surface 8 of the retaining disc 10 has a plurality of protrusions 9 arranged around the retaining disc 10 to reduce the contact area of the abutment to the spring 7.

Figure 2:
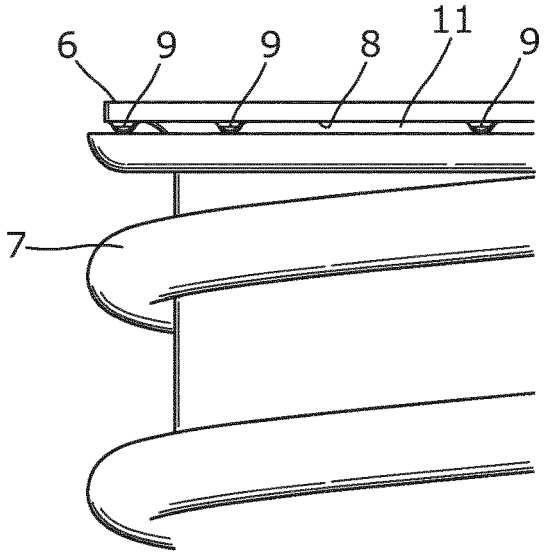
FIG. 2 shows an enlarged view of the abutment of the spring against the contact surfaces of the flange and the retaining disc, respectively.
Figure 3:
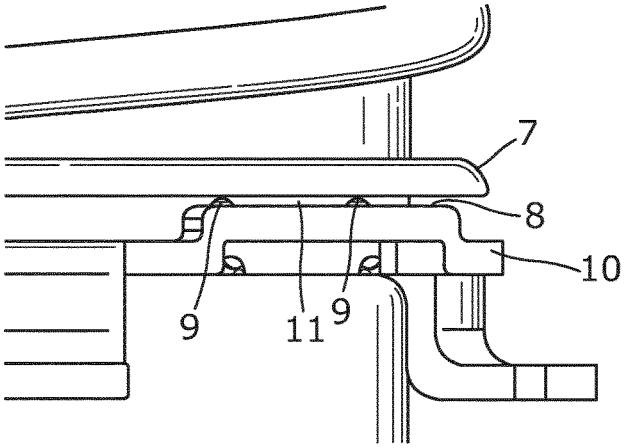
FIG. 3 shows another enlarged view of the abutment of the spring against the contact surfaces of the flange and the retaining disc, respectively.

FIGS. 2 and 3 show enlarged views of the abutment of the spring 7 against the contact surfaces 8 of the flange 6 and the retaining disc 10, respectively. As may be seen in FIGS. 2 and 3, by having the protrusions 9 as part of the contact surfaces 8, it is obtained that a space 11 is created between the contact surfaces between two abutting extractor tube elements. Hereby it is possible to have detergents flow between the contact surfaces, so that these surfaces may be cleaned during a cleaning sequences, which has not been possible in the prior art. Thus, the present invention renders it possible to clean the extractor tube elements to a higher level of cleanliness than what is obtainable by means of prior solutions.

The extractor tube 1 may also comprise additional extractor tube elements such as a body, additional springs, safety pins, etc. having contact surfaces in relation to other extractor tube elements which they may abut. These contact surfaces may also have one or more protrusions for reducing the contact area between said elements, thereby facilitating the cleaning of said elements. Furthermore, the contact surfaces may both have a horisontal abutment and/or a vertical abutment.

Figure 4:
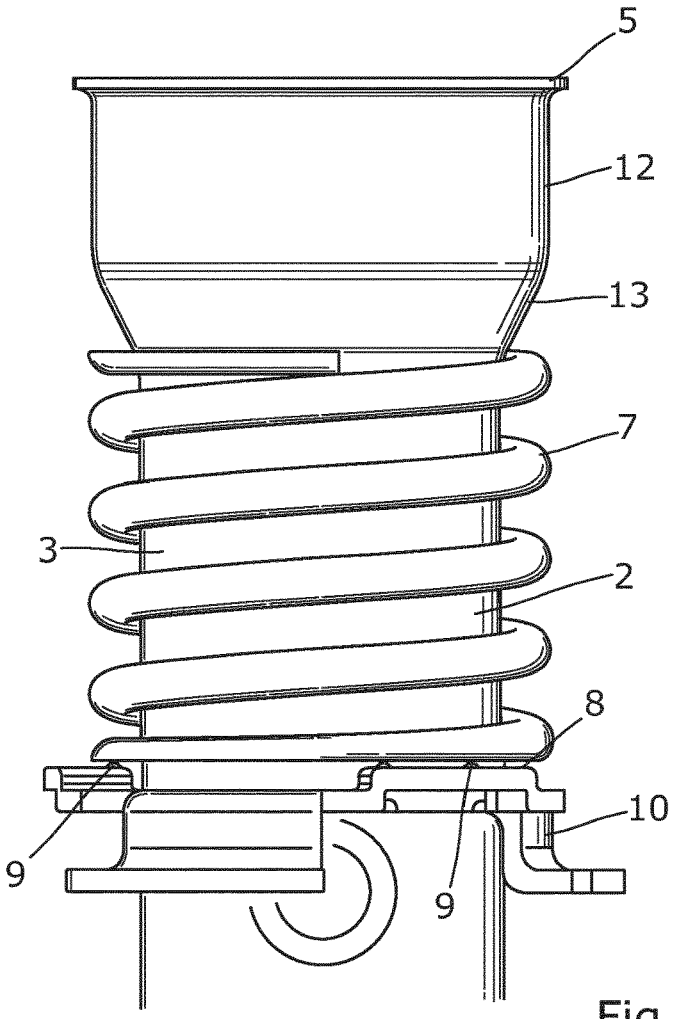
FIG. 4 shows another embodiment of an extractor tube.

In FIG. 4, another embodiment of an extractor tube 1 is shown. The extractor tube 1 of FIG. 4 is adapted to be used in a D-system. Again, only a part of the extractor tube 1 is shown.

The down tube 2 has substantially the same design as the one shown in FIG. 1. However, the down tube 2 comprises an additional tube part 12 arranged at the first end 5, the additional tube part 12 having a larger diameter than the first tube part 3, and the additional tube part 12 and the first tube part 3 being connected by an intermediate part 13 having an inclined extension. The spring 7 is adapted to abut this inclined intermediate part, whereby the contact area between the spring 7 and the intermediate part is small. Obviously, even not shown protrusions may be arranged between the intermediate part 13 and the spring 7 to further reduce the contact area.

In the opposite end of the spring 7, a retaining disc 10 is arranged around the first tube part 3. The spring 7 abuts a contact surface 8 of the retaining disc 10. The contact surface 8 of the retaining disc 10 has a plurality of protrusions 9 arranged around the retaining disc 10 in order to reduce the contact area of the abutment to the spring 7.

Figure 5:
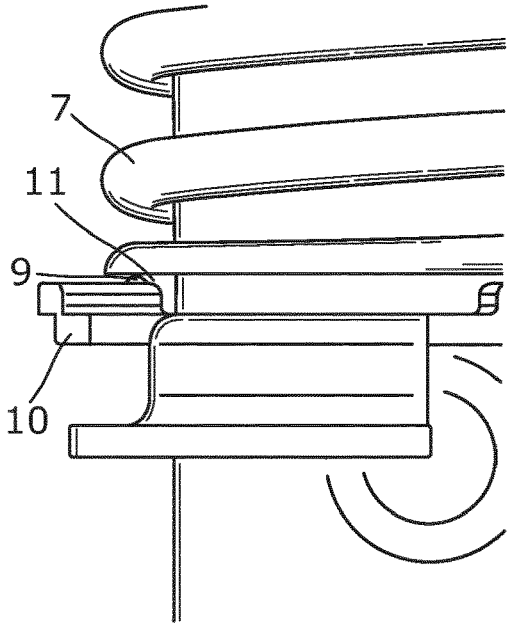
FIG. 5 shows an enlarged view of the abutment of the spring against the contact surface of the retaining disc.
Figure 6:
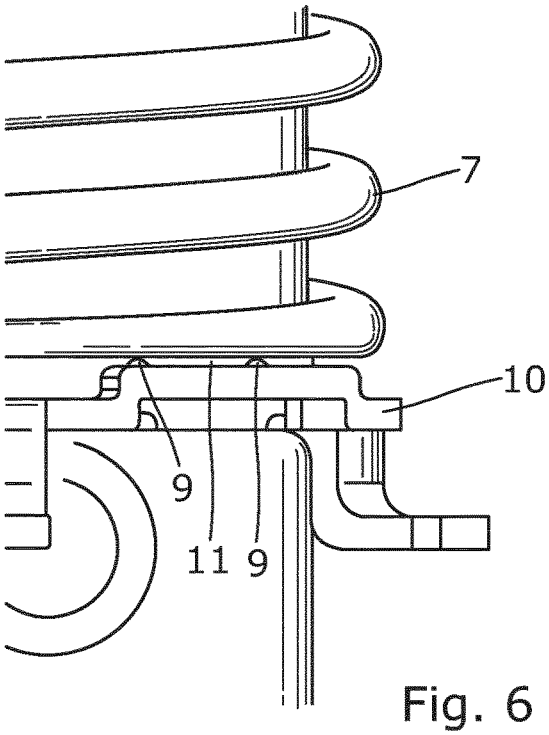
FIG. 6 shows another enlarged view of the abutment of the spring against the contact surface of the retaining disc.

FIGS. 5 and 6 show enlarged views of the abutment of the spring 7 against the contact surface 8 of the retaining disc 10. Again, the protrusions 9 are part of the contact surfaces 8 of the retaining disc 10, whereby it is obtained that a space 11 is created between the contact surfaces between to abutting extractor tube elements.

Figure 7:
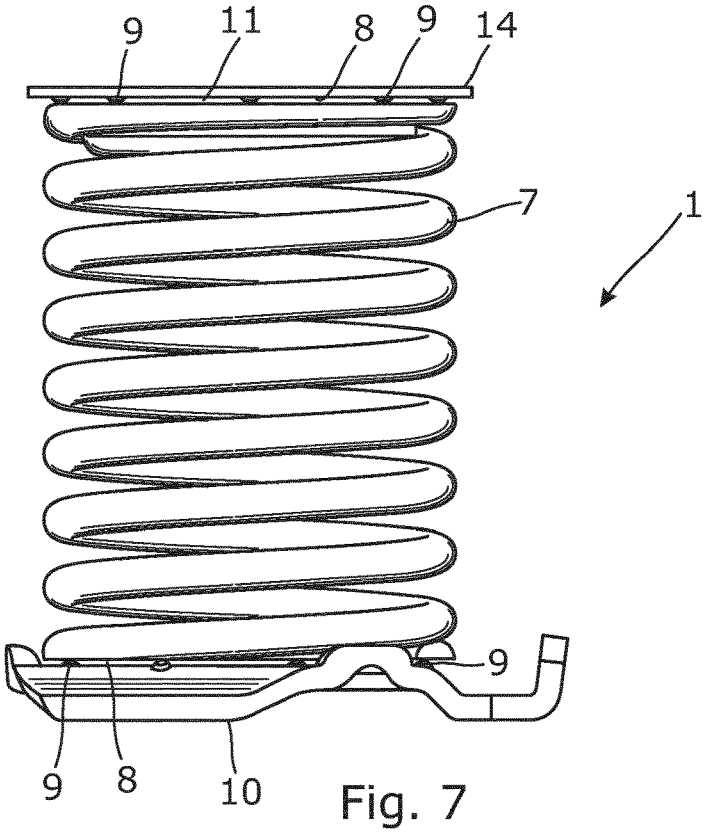
FIG. 7 shows another embodiment of an extractor tube.

In FIG. 7, another embodiment of an extractor tube 1 is shown. The extractor tube 1 of FIG. 7 is adapted to be used in an A- or a G-system. Again, only a part of the extractor tube 1 is shown.

The spring 7 abuts a washer 14 at one end. The washer 14 comprises a contact surface 8 having a plurality of protrusions 9 arranged as part of the contact surface 8 with a mutual distance between them. Again, the protrusions provide contact between the two abutting extractor tube elements, whereby the contact area is reduced only to spot contact points, and since the protrusions 9 have a height, a space 11 is created.

In the opposite end of the spring 7, a retaining disc 10 is arranged around the down tube (not shown). The retaining disc 10 may be securely connected to the down tube. The spring 7 abuts a contact surface 8 of the retaining disc 10. The contact surface 8 of the retaining disc 10 also has a plurality of protrusions 9 arranged around the retaining disc 10 to reduce the contact area of the abutment to the spring 7.

Figure 8:
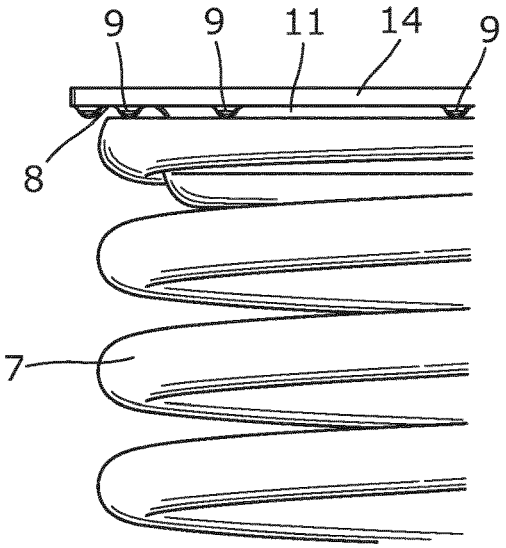
FIG. 8 shows an enlarged view of the abutment of the spring against the contact surfaces of the washer and the retaining disc, respectively.
Figure 9:
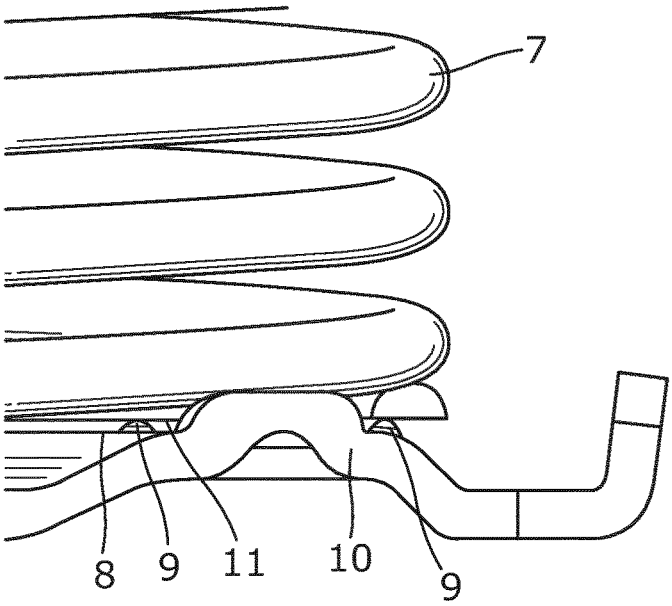
FIG. 9 shows another enlarged view of the abutment of the spring against the contact surfaces of the washer and the retaining disc, respectively.
Figure 10:
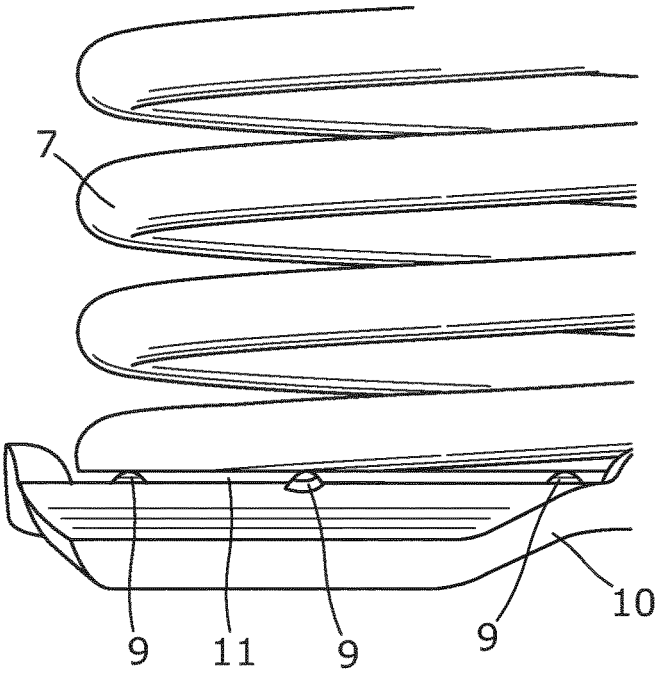
FIG. 10 shows yet another enlarged view of the abutment of the spring against the contact surfaces of the washer and the retaining disc, respectively.

FIGS. 8-10 show enlarged views of the abutment of the spring 7 against the contact surfaces 8 of the washer 14 and the retaining disc 10, respectively. FIGS. 8-10 show that by having the protrusions 9 as part of the contact surfaces 8, it is obtained that the space 11 is created between the contact surfaces between two abutting extractor tube elements. Hereby it is possible to have detergents flow between the contact surfaces, so that these surfaces may be cleaned during a cleaning sequence, which has not been possible in the prior art. Thus by the present invention it is possible to clean the extractor tube elements to a higher level of cleanliness than what is obtainable by means of the prior solutions.

The inventive idea of having contact surfaces of the extractor tube elements having one or more protrusions may be incorporated into other extractor tube systems, such as for instance the M-, U- and L-systems, which will be appreciated by the skilled person. Furthermore, by using the extractor tube elements according to the invention, it is possible to upgrade existing extractor tubes by exchanging existing extractor tube elements with extractor tube elements according to the present invention as a retrofit.

Figure 11:
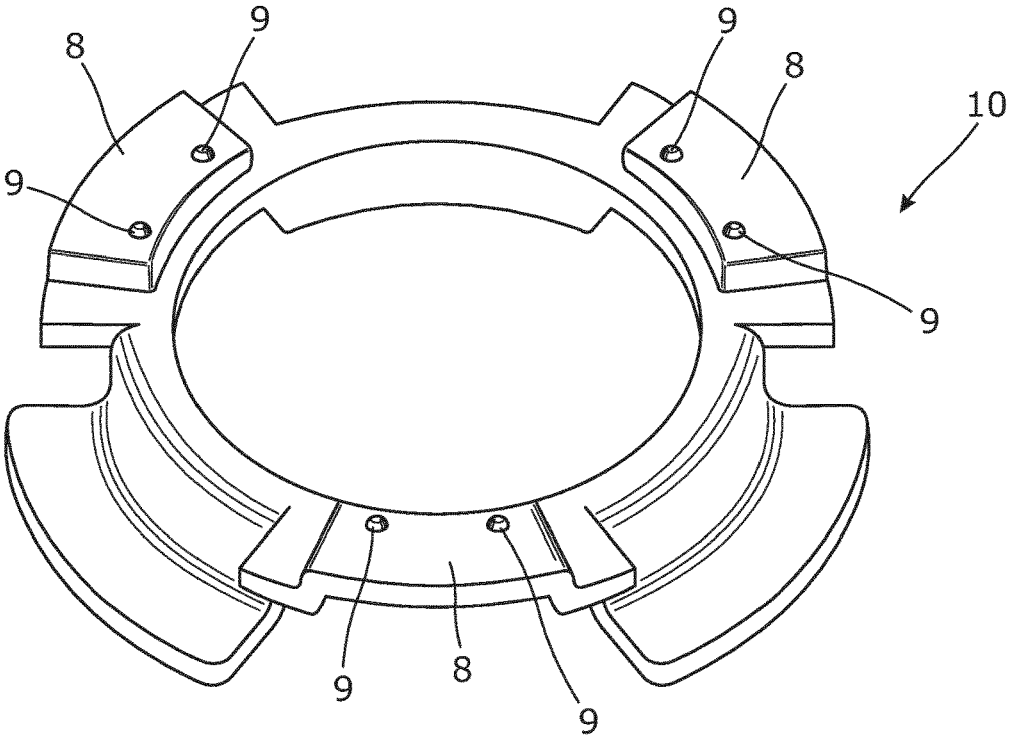
FIG. 11 shows an extractor tube element in the form of a retaining disc.

In FIG. 11, an extractor tube element in the form of a retaining disc 10 is shown. The retaining disc 10 is ring-shaped and comprises three contact surfaces 8 arranged around the disc. In this embodiment, each contact surface has two protrusions 9 projecting from the contact surface 8. In other not shown embodiments, a different number of protections may be arranged.

Also, the protrusions in the shown embodiments are shown as small cones having a rounded tip for minimising the contact area between the abutting elements. However, in other not shown embodiments, the protrusions may have a different shape, such as for instance the shape of a bead, a cone, a frustum of a cone or a hemisphere.

Figure 12:
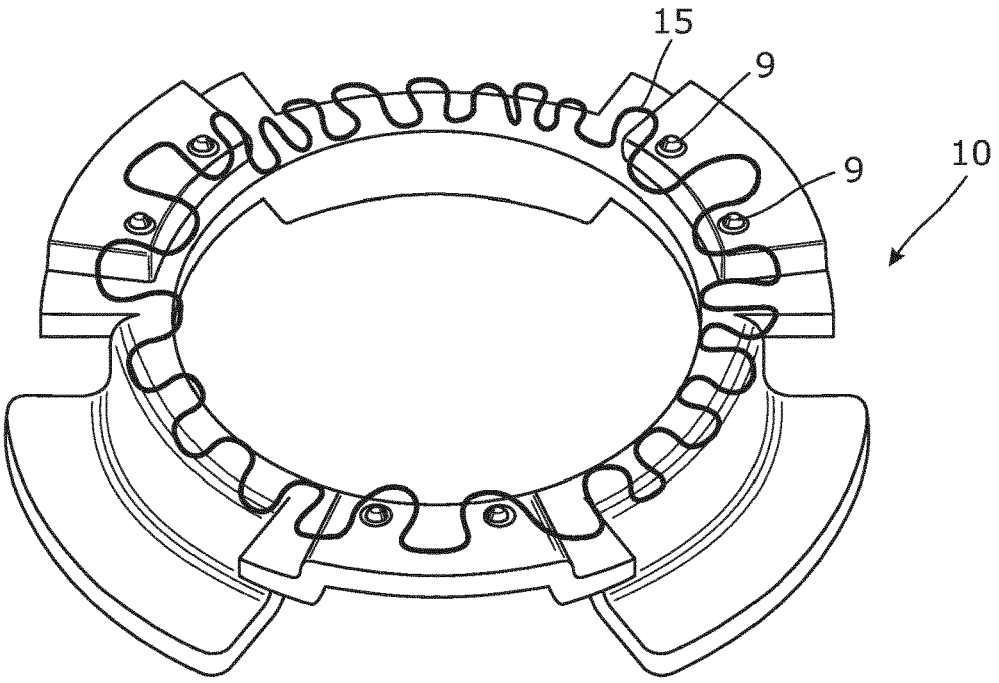
FIG. 12 shows the retaining disc of FIG. 11.

In FIG. 12, the retaining disc 10 of FIG. 11 is shown. Here it is shown how the cleaning detergent may flow (depicted by the curved line 15) between the protrusions to clean between the contact surfaces, which has not previously been possible without disassembling the extractor tube from the beverage container.

Figure 15:
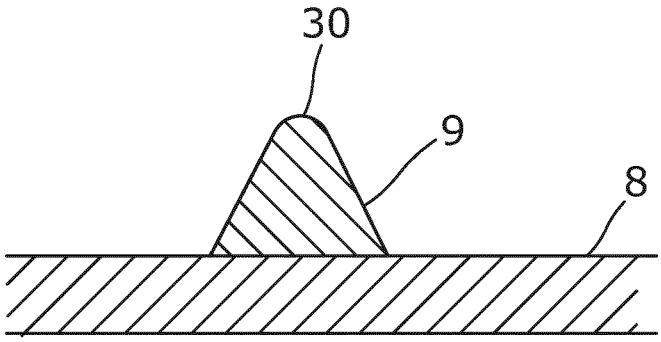
FIGS. 15-17 show different shapes of the protrusion.
Figure 16:
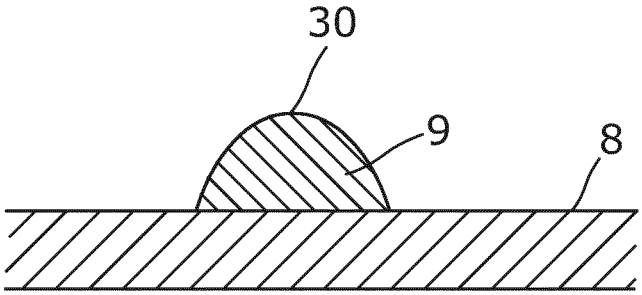
Figure 17:
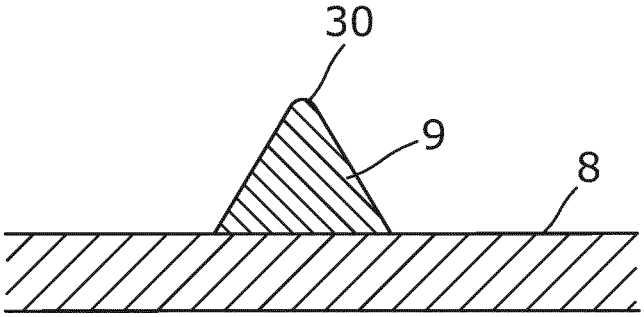

In FIGS. 15-17, different shapes of the protrusion 9 are shown in cross-sectional views. In FIG. 15, the protrusion 9 tapers from the contact surface 8 via straight lines into the contact point 30 having a rounded tip. The overall shape of the protrusion 9 in FIG. 15 is a cone. The overall shape of the protrusion 9 shown in FIG. 16 is a hemisphere where the protrusion 9 tapers into the contact point 30 via the curved extension of the hemisphere. The overall shape of the protrusion 9 shown in FIG. 17 is very similar to the one shown in FIG. 15. However, the contact point 30 is less rounded compared with the rounded tip in FIG. 15.

Figure 13:
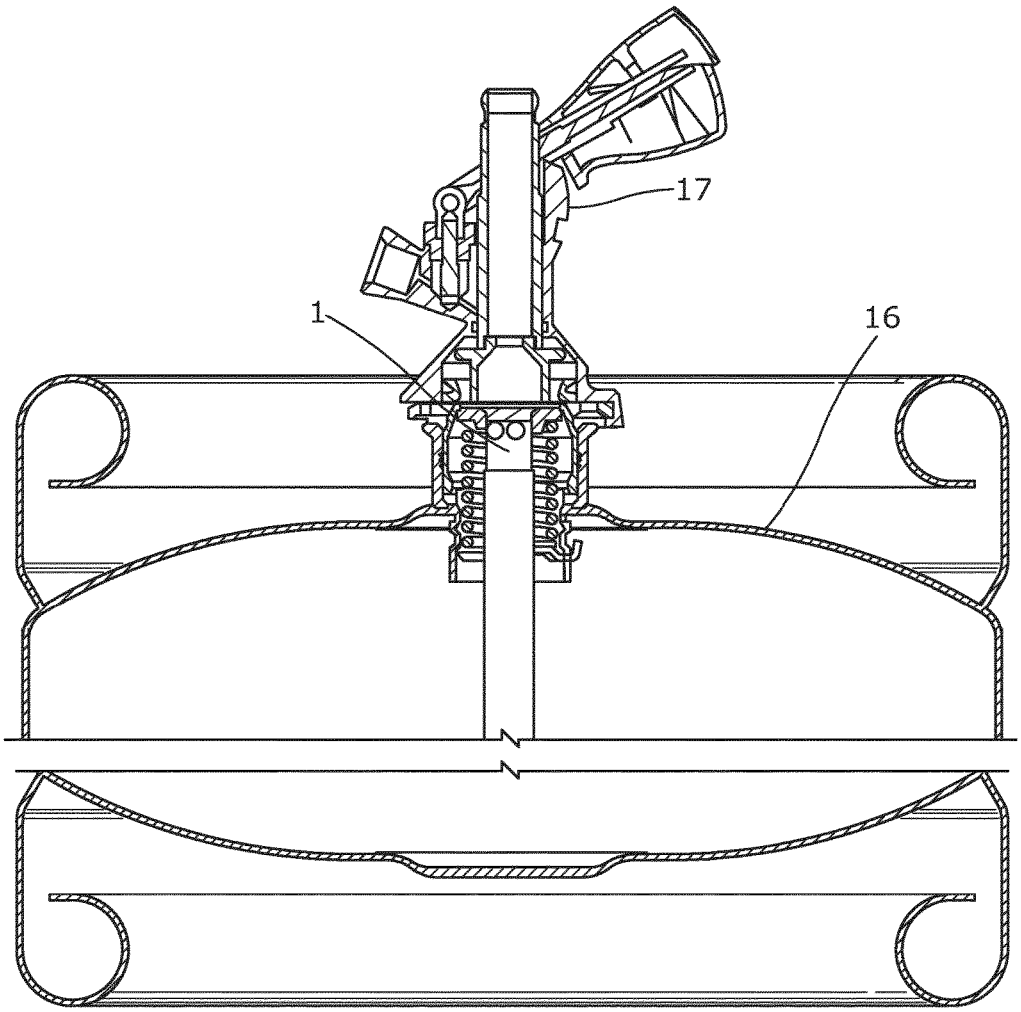
FIG. 13 shows a beverage container comprising an extractor tube having one or more extractor tube elements according to the present invention.

FIG. 13 shows a beverage container 16 comprising an extractor tube 1 having one or more extractor tube elements according to the present invention. A dispense head 17 has been mounted on the top of the extractor tube 1.

Figure 14:
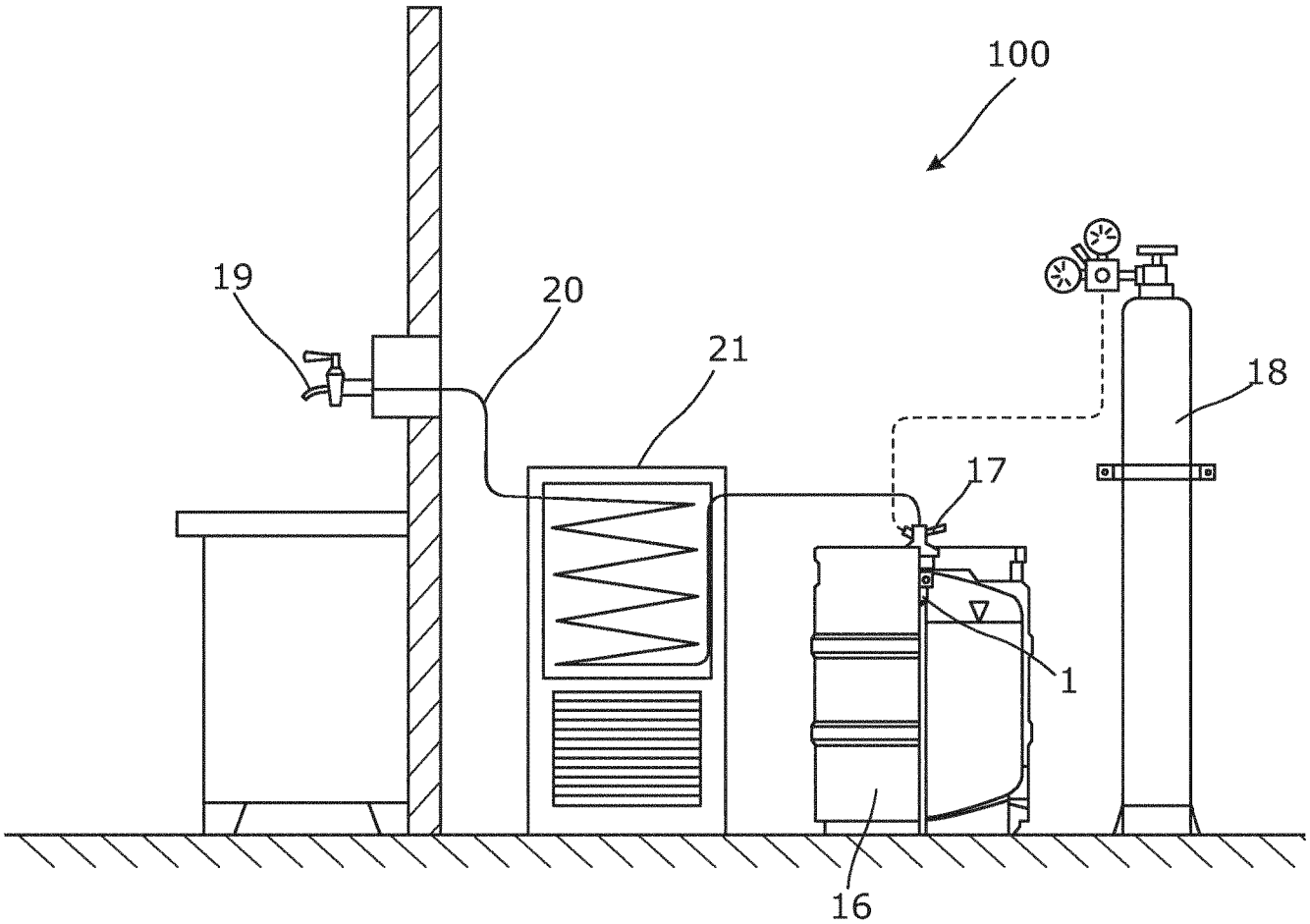
FIG. 14 shows a beverage dispensing system according to the present invention.

FIG. 14 shows a beverage dispensing system 100. The beverage dispensing system 100 comprises a beverage container 16, such as a keg. The beverage container 16 comprises the extractor tube 1 arranged in an opening (not shown) of the beverage container 16. The beverage dispensing system 100 also comprises a gas supply 18. The gas supply 18 may for instance be a CO2 cylinder and may be connected to a dispense head 17.

A dispensing tap 19 is connected to the dispense head 17 via a dispensing line 20. In this embodiment, a cooling device 21 is arranged between the dispensing tap 19 and the dispense head 17 to cool the beverage before dispensing.

During operation of the beverage dispensing system 100, the gas supply 18 supplies pressurised gas, such as CO2 or other suitable gasses, to the dispense head 17 and then to the top of the beverage container 16 in order to displace the beverage. When the dispensing tap 19 is opened, the CO2 will start displacing the beverage from the top of the beverage container 16, causing the beverage at the bottom of the beverage container 16 to flow via the extractor tube 1 into a flow channel in the dispense head 17 and further into the dispensing line 20.

When the beverage container has been emptied and is to be refilled again, the beverage container 16 and the extractor tube 1 must be cleaned first. The cleaning method comprises the following steps:

emptying the beverage container 16 of remaining beverage, flushing the beverage container 16 with a detergent solution at a predetermined temperature, and circulating the detergent solution between two abutting contact surfaces 8 wherein one of the contact surfaces 8 is of an extractor tube element according to the present invention.

Since the protrusions 9 are part of the contact surfaces 8 of the extractor tube element, it is obtained that space 11 is created between the contact surfaces between to abutting extractor tube elements. During cleaning it is therefore possible to have detergents flow between the contact surfaces, so that these surfaces may be cleaned during the cleaning sequences, which has not been possible in the prior art. Thus, by the present invention it is possible to clean the extractor tube elements to a higher level of cleanliness than what is obtainable by means of the prior solutions.

In addition, the beverage container may also be steamed at a predetermined temperature after it has been flushed with the detergent solution.

Although the invention has been described in the above in connection with preferred embodiments of the invention, it will be evident for a person skilled in the art that several modifications are conceivable without departing from the invention as defined by the following claims.

The invention claimed is:

1. The extractor tube assembly for a beverage container, comprising:

an extraction tube; and a first extractor tube element and a second extractor tube element;

the first extractor tube element having a first contact surface extending radially outwards from an exterior surface of the extraction tube, the first contact surface being positioned and arranged so as to abut a second surface of the second extractor tube element, wherein the first contact surface has at least one protrusion, the at least one protrusion tapering into a contact point for reducing a contact area between the first extractor tube element and the second extractor tube element and for creating space between the abutting first and second extractor tube elements to facilitate cleaning.

2. The extractor tube assembly according to claim 1, wherein the first contact surface has a plurality of protrusions.

3. The extractor tube assembly according to claim 1, wherein the tube contact point has a rounded tip.

4. The extractor tube assembly according to claim 1, wherein the at least one protrusion has the shape of a bead, a cone, a frustum of a cone or a hemisphere.

5. The extractor tube assembly according to claim 1, wherein the at least one protrusion has a height of 1 mm to 10 mm.

6. The extractor tube assembly according to claim 1, wherein the first contact surface is substantially circular.

7. The extractor tube assembly according to claim 6, wherein the at least one protrusion has a plurality of protrusions extending along the first contact surface with a mutual distance between the plurality of protrusions.

8. The extractor tube assembly according to claim 1, wherein the at least one protrusion forms part of the first contact surface.

9. The extractor tube assembly according to claim 1, wherein the first extractor tube element is a retaining disc, a flange, a safety pin, a washer, a spring, a locking plate, a support plate, or a combination thereof.

10. The extractor tube assembly according to claim 1, wherein the first contact surface has a horizontal abutment and/or a vertical abutment.

11. A beverage container comprising the extractor tube assembly according to claim 1.

12. A beverage dispensing system comprising a beverage container according to claim 11 and a dispense head.

13. A cleaning method for cleaning a beverage container according to claim 11, comprising:

emptying the beverage container of remaining beverage, flushing the beverage container with a detergent solution at a predetermined temperature, and circulating the detergent solution between two the first and second abutting contact surfaces wherein one of the contact surfaces is of an extractor tube element.

14. The cleaning method according to claim 13 comprising steaming the beverage container at a predetermined temperature.

* * * * *